US008201583B2

(12) United States Patent
Peneder

(10) Patent No.: US 8,201,583 B2
(45) Date of Patent: Jun. 19, 2012

(54) SUPPORT FOR THE BUILDING INDUSTRY AND METHOD FOR THE PRODUCTION OF A PIPE OF A SUPPORT FOR THE BUILDING INDUSTRY

(75) Inventor: Johann Peneder, Ferschnitz (AT)

(73) Assignee: Doka Industrie GmbH, Amstetten, Österreich (AT)

( * ) Notice: Subject to any disclaimer, the term of this patent is extended or adjusted under 35 U.S.C. 154(b) by 520 days.

(21) Appl. No.: 12/446,956

(22) PCT Filed: Oct. 18, 2007

(86) PCT No.: PCT/EP2007/061147

§ 371 (c)(1),
(2), (4) Date: Apr. 23, 2009

(87) PCT Pub. No.: WO2008/049780

PCT Pub. Date: May 2, 2008

(65) Prior Publication Data

US 2009/0266008 A1 Oct. 29, 2009

(30) Foreign Application Priority Data

Oct. 23, 2006 (DE) ..... 10 2006 049 841

(51) Int. Cl.
*F16L 11/00* (2006.01)

(52) U.S. Cl. ..... 138/109; 138/177; 138/178; 52/126.2

(58) Field of Classification Search ..... 138/109, 138/177, 122; 52/126.2; 29/897
See application file for complete search history.

(56) References Cited

U.S. PATENT DOCUMENTS

| | | | | |
|---|---|---|---|---|
| 298,657 | A * | 5/1884 | Bennett | 138/109 |
| 627,293 | A * | 6/1899 | Brighton | 164/95 |
| 1,783,605 | A * | 12/1930 | Della | 285/4 |
| 2,236,802 | A * | 4/1941 | McDonald | 138/113 |
| 2,261,056 | A * | 10/1941 | Dunn | 72/340 |
| 3,823,216 | A * | 7/1974 | Petzetakis | 264/571 |
| 5,099,888 | A * | 3/1992 | Valls, Jr. | 138/109 |
| 5,711,177 | A * | 1/1998 | Mitsubayashi et al. | 72/342.1 |
| 5,743,301 | A * | 4/1998 | Winship | 138/109 |
| 6,016,843 | A * | 1/2000 | Wada et al. | 138/109 |
| 2006/0220379 | A1 * | 10/2006 | Arima et al. | 285/256 |

FOREIGN PATENT DOCUMENTS

| | | | |
|---|---|---|---|
| CA | 2 284 123 | A1 | 3/2000 |
| CA | 2 292 206 | A1 | 6/2000 |
| DE | 76 36 864 | U1 | 3/1977 |
| DE | 26 28 924 | A1 | 12/1977 |
| DE | 41 11 169 | A1 | 10/1992 |
| DE | 44 31 145 | A1 | 3/1995 |

(Continued)

*Primary Examiner* — Patrick F Brinson
(74) *Attorney, Agent, or Firm* — Fitch, Even, Tabin & Flannery, LLP

(57) ABSTRACT

The invention relates to a support for the building industry, comprising a pipe (10), which has an axial profile in at least one end section, which is accessible from the outside when in use. The outside and/or inside diameters and/or the wall thickness in at least one end region of the pipe are enlarged compared to the remainder of the pipe (10). During production of a pipe or support in the building industry, the outside and/or inside diameters and/or the wall thickness is increased in that at least one end section, which is assessable from the outside when in use, compared to the remainder of the pipe and the pipe has an axial profile.

17 Claims, 1 Drawing Sheet

FOREIGN PATENT DOCUMENTS

| | | | |
|---|---|---|---|
| DE | 198 44 613 | A1 | 3/2000 |
| EP | 0 493 184 | B1 | 7/1992 |
| EP | 0 625 622 | A1 | 11/1994 |
| EP | 1 013 850 | A1 | 6/2000 |
| GB | 213 317 | | 4/1924 |

* cited by examiner

SUPPORT FOR THE BUILDING INDUSTRY AND METHOD FOR THE PRODUCTION OF A PIPE OF A SUPPORT FOR THE BUILDING INDUSTRY

FIELD OF THE INVENTION

The invention relates to a support for the building industry and a method for the production of a pipe of a support for the building industry.

In the building industry, supports that are normally height-adjustable are used, for example, to construct floor formworks. For this purpose, numerous supports are distributed across a surface and are vertically adjusted, and beams that normally extend in a first horizontal direction are placed on the supports. Numerous other beams that extend in a second horizontal direction are placed on these beams. A plurality of formwork panels are arranged close together on the second set of beams so as to be able to cast, for example, a concrete floor hereon.

Once the concrete has hardened, the supports, all of the beams and the formwork panels are removed. Impact can be applied to the supports both when removing the formwork and when adjusting the supports in order to displace them. This normally occurs by using a hammer to apply blows to a lower region of the support since it is here that the best effect as regards displacement of the support in the lower region thereof is achieved. These blows may be applied with a special hammer, for example a hammer that is coated with a rubber layer, in order to prevent damage to the pipe of the support when applying the hammer blows. However, such a specific hammer is not always available on a construction site and, thus, the described blows are often applied using hammers that are not adapted for this purpose or other objects such as, for example, squared timber. The problem here is that dents can be formed in the outer pipe, which subsequently prevent or make difficult movement of the inner pipe inside the outer pipe, and thus the telescoping ability and height-adjustability of the support is negatively affected and, in the worst case, the support becomes unusable.

Prior Art

Known from DE 44 31 145 A1 is a height-adjustable support for a floor formwork, in which the outer pipe is provided, in the region of a floor plate, with a widened section that has a larger outer diameter.

DE 76 36 864 U1 relates to a height-adjustable support having an outer pipe, the head or foot piece of which has a so-called attachment piece that may have bead with a larger diameter.

DESCRIPTION OF THE INVENTION

The object forming the basis for the invention is to create a support for the building industry that is suitable for meeting the demands made thereon particularly well. Furthermore, a method for the production thereof is to be created.

This object is solved on the one hand by the support described in claim 1.

According thereto, this support comprises a pipe which has an axial profile in at least one end region that is accessible from the outside when in use, the outer and/or inner diameter and/or the wall thickness in at least one end region of said pipe being enlarged as compared to the rest of the pipe. The described end region is particularly stable owing to the enlargement of the outer diameter, the inner diameter and/or the wall thickness. This is especially advantageous in particular for the lower end region since it is here that the described blows for adjusting the support are applied. The advantageous effect of enlarging the wall thickness and the outer diameter essentially lies in the fact that the stability is improved in this region. This means that the pipe can better withstand the described blows, and deformations become considerably less likely. If the inner diameter is alternatively or additionally enlarged, this has the effect that any dents that may be formed reach far less often the area in which the inner pipe, which is shiftable inside the outer pipe, is located. In other words, even if dents are formed, the corresponding small bulges in the interior of the pipe prevent or block movement of the inner pipe in far fewer cases. The overall functionality of the support is hereby considerably improved.

The axial profile cooperates with the aforementioned measures in various ways. On the one hand, it visually indicates to the user the region that is enforced in order to achieve the aforementioned effects. The axial profile visually indicates to the user in an easily recognisable manner where the necessary blows are to be applied. These blows can hereby be restricted to that area in which the pipe is particularly stable, and negative effects on the functionality that result from blows in zones that are not suitable therefor can be clearly reduced. On the other hand, it was discovered that the axial profile contributes to the stability of the pipe. In other words, even if the outer and/or inner diameter is only enlarged in places, namely according to the axial profile, this contributes to the stability of the pipe and the resistance to deformations. It was surprisingly found that force can be introduced to the wall of the pipe in a particularly favourable manner via the axial profile when blows are applied to the pipe, and thus the likelihood and extent of dents on the outside and bulges on the inside can be reduced for this reason as well. Force is introduced to a certain extent tangentially in the direction of the circumference of the pipe and to a lesser extent radially, which would lead to the described dents.

Furthermore, the axial profile has the advantageous effect that dents and the like visibly appear considerably less often. Thus, the appearance of the pipe is improved even after a long period of use since unavoidable dents and other damage is considerably more difficult to see than is the case in a smooth pipe. As a further effect it is mentioned that the axial profile advantageously leads to a structural alteration, in particular a structural compression, of the steel used, and thus the pipe attains increased stability for this reason as well. Therefore, alloyed steels with a defined carbon proportion and/or manganese as the alloying element are preferred for the outer pipe of the support according to the invention.

Preferred embodiments of the support according to the invention are described in the other claims.

A region of 15 cm to 20 cm, measured from the lower end, has proven to be particularly advantageous for the end region in which the pipe has an axial profile and in which the inner and/or outer diameter and/or the wall thickness of the pipe is enlarged. The blows for displacing the support are particularly effective in this region since they are applied comparatively close to the lower end of the support such that this can be shifted and vertical adjustment can be achieved in a favourable manner. When in use, the lower end is in the region of the ground, the underground or the building floor, on which the pipe is positioned and may comprise a foot plate for this purpose.

While the described region can be located at least in the cited zone of 15 cm to 20 cm, measured from the bottom end, it can extend considerably further. It has hereby proven to be advantageous if it extends up to a point that is a few centimetres from the lower end and/or up to a point that is 30 cm from the lower end. If the lower end itself does not have an axial profile, this has the advantage that it is easier to attach a plate, in particular a foot plate of an outer pipe, preferably by means of welding. The enlargement of the inner and/or outer diameter and/or the wall thickness can, however, also be provided in this region. The same advantage exists in the case that the teaching according to the invention is applied to the inner pipe, which is normally the upper pipe and accordingly has a head plate.

Particularly preferred at the present is an embodiment in which the inner and outer diameter is enlarged, however the wall thickness, compared to the rest of the pipe, remains the same. Particularly good properties could be determined herefor. It was furthermore possible to develop a particularly favourable manufacturing method herefor, in which the region in question is first of all compressed in order to enlarge the wall thickness, and the inner and outer diameter of the pipe is then expanded such that at least almost the same wall thickness occurs in the enlarged region as in the rest of the pipe.

As regards the profile, it is currently preferred for this to have a largely wave-like form, when viewed in cross-section. Such a form ensures an optically attractive and harmonious design. The wave form furthermore prevents the formation of zones at which tension peaks could form.

A profile having angular peaks on the outer diameter has proven to have particularly favourable properties. In other words, the peaks on the outside are slightly flattened, such that two edges are formed at each peak next to the flattened area. The flattened areas allow hammer blows to be applied thereto without any traces of these blows being immediately apparent, as is the case for a rounded peak. Furthermore, the introduced force is introduced to such flattened peaks in a particularly favourable manner, namely tangentially in the pipe circumference such that deformations are reduced.

The aforementioned object is furthermore solved by a method for the production of a pipe of a support for the building industry, in which the outer diameter and/or inner diameter and/or the wall thickness in at least one end region is enlarged as compared to the rest of the pipe, and in which the pipe has an axial profile.

As described above, a support that meets the requirements particularly well can be produced with this method.

As mentioned above, it is particularly preferred in this regard for widening and/or axial compression to occur in order to form the described end region. Particularly favourable results are achieved if axial compression first of all takes place in order to increase the wall thickness, and then expansion is carried out to increase the inner and outer diameter, with the resulting wall thickness at least largely corresponding to the wall thickness of the rest of the pipe. Profiling can take place once or repeatedly as well as before, during or after compression and/or expansion.

The other preferred embodiments of the method according to the invention correspond to the preferred embodiments of the support produced therewith. In the case that the axial profile has been applied right up to the edge of the pipe, the region directly at the edge of the pipe can, within the scope of the method, be smoothed, rounded and/or formed back into a cylinder in order to facilitate joining with a head or foot plate, for example by means of welding.

BRIEF DESCRIPTION OF THE DRAWINGS

The invention will be explained in more detail in the following by means of an embodiment that is shown by way of an example in the drawings, in which.

DETAILED DESCRIPTION OF A PREFERRED EMBODIMENT OF THE INVENTION

Figure 1:
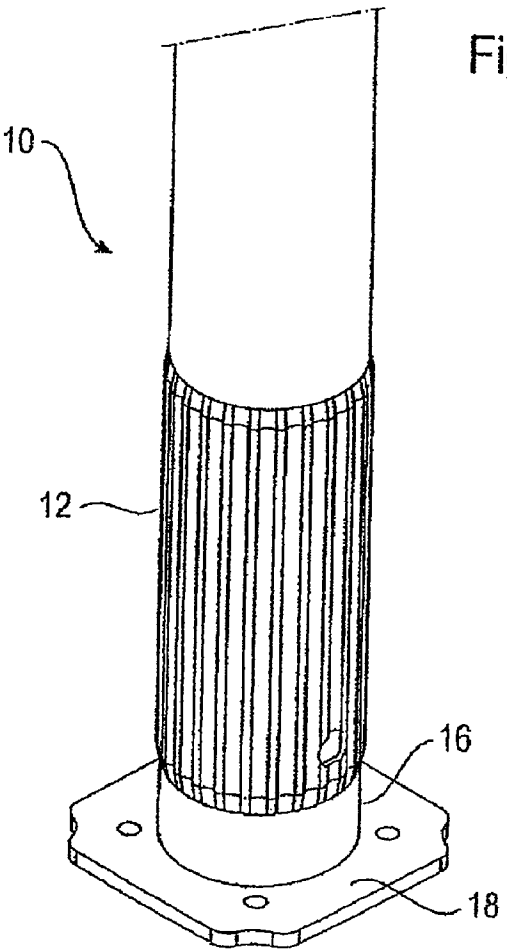
FIG. 1 shows a perspective view of an end region of a pipe of the support according to the invention.

Shown in FIG. 1 is a perspective view of the lower region of a pipe 10 of a support for the building industry. In the shown embodiment, it is an outer pipe that has a foot plate 18 at its lower end. However, the pipe could also be an inner pipe, in which case the shown plate would act as a head plate. In the case of the shown outer pipe, an inner pipe is accommodated inside the outer pipe such that it is shiftable in the axial direction thereof. When a floor formwork is set up, numerous supports having an outer pipe, the lower region of which is shown by way of an example in FIG. 1, are vertically adjusted. To do so, blows, for example using a hammer, are applied to a region 12 that is located comparatively close to the lower end in order to be able to shift the outer pipe effectively.

As is apparent from FIG. 1, the addressed region is designed in a specific manner to the effect that it has an axial profile, and in the shown case, both the outer diameter and the inner diameter thereof are enlarged as compared to the rest of the pipe. In the shown example, the wall thickness is approximately the same as the wall thickness of the rest of the pipe. Furthermore, a lowermost region 16, which in other words abuts the foot plate 18, is not enlarged and has not been provided with a profile in the shown case, and thus it is particularly easy to attach the pipe to the foot plate in this region.

Figure 2:
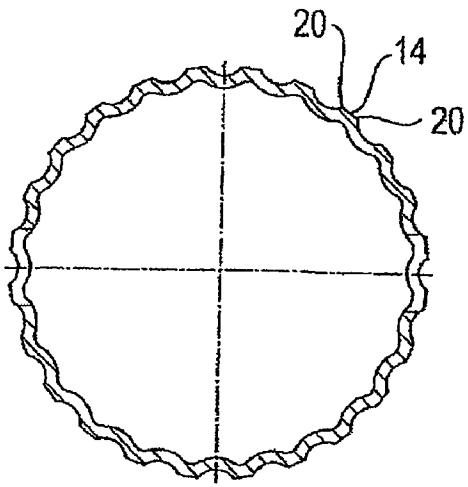
FIG. 2 shows a sectional view of the end section shown in FIG. 1 in the region of the profile.

FIG. 2 shows a sectional view of the region 12 that is designed in a specific manner. As is apparent from FIG. 2, the axial profile is designed substantially in wave form. The peaks 14 present on the outside are thereby slightly flattened so that two edges 20 are formed in each case. The force can be transferred particularly well with a hammer in the region of the flattened area, and this force is introduced tangentially to the pipe wall in a beneficial manner. It shall be understood that the peaks on the inside can be alternatively or additionally flattened and accordingly provided with edges. Finally, it is mentioned that in the shown example, the smallest inner diameter, in other words the inner diameter resulting from the peaks on the inside, is enlarged as compared to the rest of the pipe. As a result hereof, it is possible, as described above, to achieve the effect that also in the case where a dent on the outside of the pipe leads to a bulge on the inside, the movement of the inner pipe is not affected and the telescopic ability is accordingly maintained. As is apparent from FIG. 2, the axial profile can be described to the effect that it leads to largely axially extending ribs with grooves therebetween.

The invention claimed is:

1. A support for building industry comprising a pipe having at least one end region with an axial profile that is accessible from the outside when in use, the pipe configured to have a compressive strength to support a building structure when vertically installed, the at least one end region of the pipe having an enlarged inner diameter and a wall thickness the same size or larger, as compared to the rest of the pipe.

2. The support according to claim 1, wherein the end region is a part of the pipe with a length of about 15 cm to 20 cm, measured from the lower end of the pipe.

3. The support according to claim 1, wherein the region with the enlarged diameter begins several centimeters from the lower end of the pipe.

4. The support according to claim 3, wherein the enlarged diameter extends up to a point that is about 30 cm from the lower end of the pipe.

5. The support according to claim 4, wherein the wall thickness in the end region is substantially the same size as of the rest of the pipe.

6. The support according to claim 5, wherein a wall of the end region has a wave-like profile in cross section.

7. The support according to claim 6, wherein the profile has angular peaks on an outer diameter.

8. A method for production of a pipe of a support for building industry, comprising:

providing a pipe with an axial profile, the pipe configured to have a compressive strength to support a building structure when vertically installed;

forming at least one end region in the pipe by enlarging the inner diameter of the pipe in a place where the pipe is accessible from the outside when in use.

9. The method according to claim 8, wherein the end region is formed by widening of the pipe.

10. The method according to claim 8, wherein the end region is formed in the pipe at a length at least of 15 cm to 20 cm, measured from the lower end of the pipe.

11. The method according to claim 8, comprising forming a smooth section between the lower end of the pipe and the enlarged end region.

12. The method according to claim 8, further comprising: enlarging wall thickness of the end region.

13. The method according to claim 8, wherein the end region is formed by axial compression of the pipe.

14. A support for building industry comprising a pipe having at least one end region with an axial profile that is accessible from the outside when in use, the at least one end region of the pipe having an enlarged inner diameter and a wall thickness substantially the same size as compared to the rest of the pipe, wherein a wall of the end region has a wave-like profile in cross section.

15. The support according to claim 14, wherein the region with the enlarged diameter begins several centimeters from the lower end of the pipe.

16. The support according to claim 15, wherein the enlarged diameter extends up to a point that is about 30 cm from the lower end of the pipe.

17. The support according to claim 14, wherein the profile has angular peaks on an outer diameter.

* * * * *